US010076170B2

(12) United States Patent
Gardner et al.

(10) Patent No.: US 10,076,170 B2
(45) Date of Patent: Sep. 18, 2018

(54) CHILDREN'S ZIPPER PULL

(71) Applicant: Lucky Cat Inc. LLC, Arlington, VA (US)

(72) Inventors: Kelly Gardner, Arlington, VA (US); Sebastian Gardner, Arlington, VA (US); Phoebe Gardner, Arlington, VA (US)

(73) Assignee: Lucky Cat Inc. LLC, Arlington, VA (US)

( * ) Notice: Subject to any disclaimer, the term of this patent is extended or adjusted under 35 U.S.C. 154(b) by 1 day.

(21) Appl. No.: 15/480,688

(22) Filed: Apr. 6, 2017

(65) Prior Publication Data

US 2017/0215538 A1 Aug. 3, 2017

Related U.S. Application Data

(63) Continuation of application No. 14/704,612, filed on May 5, 2015, now Pat. No. 9,630,750.

(60) Provisional application No. 61/990,654, filed on May 8, 2014.

(51) Int. Cl.

| | |
|---|---|
| ***A45C 13/10*** | (2006.01) |
| ***B65D 25/28*** | (2006.01) |
| ***A63H 33/00*** | (2006.01) |
| ***B65D 30/06*** | (2006.01) |
| ***B65D 33/06*** | (2006.01) |
| ***B65D 77/00*** | (2006.01) |
| ***A45C 3/00*** | (2006.01) |
| ***B65D 33/04*** | (2006.01) |

(52) U.S. Cl.

CPC ..... *A45C 13/103* (2013.01); *A45C 3/001* (2013.01); *A63H 33/00* (2013.01); *B65D 25/28* (2013.01); *B65D 29/04* (2013.01); *B65D 33/04* (2013.01); *B65D 33/06* (2013.01); *B65D 77/006* (2013.01); *A45C 2003/002* (2013.01)

(58) Field of Classification Search

CPC ..... A44B 19/26; A44B 19/262; A44B 19/42; A01K 1/0254; A45C 3/00; A45C 7/0036; A45C 7/0068; A45C 13/02; A45C 2007/0004; B65D 29/04; B65D 33/02; B65D 33/06

USPC ..... 24/415, 419, 429, 431; 119/482, 119/496–497, 500; 190/125; 206/216, 206/315.1, 579; 220/7, 9.2, 9.4, 481, 220/485; D11/87, 200, 221

See application file for complete search history.

(56) References Cited

U.S. PATENT DOCUMENTS

| | | | | | |
|---|---|---|---|---|---|
| 1,752,111 | A * | 3/1930 | Rutherford | A44B 19/26 | 24/415 |
| 2,497,740 | A * | 2/1950 | Poux | A44B 19/262 | 16/110.1 |
| D234,412 | S * | 3/1975 | Swan | D11/221 | |
| D254,761 | S * | 4/1980 | Davis | D11/221 | |
| 4,928,358 | A * | 5/1990 | Ishii | A44B 19/262 | 24/419 |

(Continued)

*Primary Examiner* — J. Gregory Pickett
*Assistant Examiner* — Brijesh V. Patel
(74) *Attorney, Agent, or Firm* — Koffsky Schwalb LLC; Mark I. Koffsky

(57) ABSTRACT

A storage solution for children's toys is described. A storage and transportation device for children's items (e.g., toys, puzzles, craft supplies, etc.) is specially designed to be used by children, including children under three years old. The storage solution may also include an improved zipper pull for opening and closing the storage and transportation device.

6 Claims, 2 Drawing Sheets

(56) References Cited

U.S. PATENT DOCUMENTS

| | | | | | |
|---|---|---|---|---|---|
| 5,075,066 | A | * | 12/1991 | Terada | A44B 19/262 264/247 |
| D326,248 | S | * | 5/1992 | Horita | D11/200 |
| D339,768 | S | * | 9/1993 | Takemura | D11/221 |
| D371,327 | S | * | 7/1996 | Kawamura | D11/221 |
| D435,808 | S | * | 1/2001 | Odgard | D11/221 |
| D482,987 | S | * | 12/2003 | Ritter | D11/221 |
| D495,623 | S | * | 9/2004 | Nordstrom | D11/221 |
| D499,667 | S | * | 12/2004 | Fenton | D11/221 |
| D575,191 | S | * | 8/2008 | Kojima | D11/221 |
| D685,668 | S | * | 7/2013 | Guerrero, II | D11/79 |
| D718,053 | S | * | 11/2014 | McFreen | D3/279 |
| 2003/0194152 | A1 | * | 10/2003 | Peska | B65D 31/12 383/40 |
| 2005/0155891 | A1 | * | 7/2005 | Chen | B65D 5/3628 206/524.8 |
| 2005/0199625 | A1 | * | 9/2005 | Salamone | A45C 7/0031 220/9.2 |
| 2011/0155611 | A1 | * | 6/2011 | Armstrong | A45C 7/0081 206/503 |
| 2011/0174811 | A1 | * | 7/2011 | Sabounjian | D06F 95/002 220/9.2 |
| 2013/0007994 | A1 | * | 1/2013 | Iannello | A44B 19/262 24/429 |
| 2013/0312230 | A1 | * | 11/2013 | Chang | A44B 19/262 24/429 |

* cited by examiner

CHILDREN'S ZIPPER PULL

RELATED APPLICATION

This application is a continuation of U.S. patent application Ser. No. 14/704,612, filed on May 5, 2015, which claims the benefit of the U.S. Provisional Patent Application Ser. No. 61/990,654 filed on May 8, 2014.

FIELD OF THE DISCLOSURE

The present disclosure relates generally to storage solutions for children's toys. In particular, the disclosure relates to a storage and transportation device for children's items (e.g., toys, puzzles, craft supplies, etc.) that is specially designed to be used by children, including children under three years old. The storage solution may also include an improved zipper pull for opening and closing the storage and transportation device.

BACKGROUND

At present, there are limited options for products for the storage and transportation of children's items that have been specifically designed for use by children, including children under three years old.

The current offerings for storage of children's items may be categorized as "baskets", "boxes", "bins" and "drawers." (For illustrative examples, see: http://www.potterybarnkids.com/shop/kids/storage/baskets-boxes-buckets/, http://www.landofnod.com/nursery-storage/kids-storage-and-shelving/, http://www.thecompanystore.com/kids-furniture/storage-organization, and http://www.containerstore.com/shop/toyStorage) (all websites referenced herein are as of Apr. 30, 2015).

The current offerings for the transportation of children's items that have been specifically designed for use by children are largely scaled-down tote bags, backpacks and suitcases. (For illustrative examples, see: http://www.potterybarnkids.com/shop/backpacks-luggage/?cm_type=1nay, http://www.landofnod.com/backpacks-and-totes/storage/1 and http://www.thecompanystore.com/ck-totes-bags Plastic storage bags, such as disposable Ziploc bags or zippered storage bags that are not designed to be thrown away (e.g., http://www.containerstore.com/shop/storage/storageBags?productId=11001275&N71237), come in a variety of sizes and are an obvious and easy solution for storing and transporting items, in particular items having multiple parts or pieces. However, such storage bags are neither intended for, nor suitable for, use by children.

Baskets, boxes, bins and drawers do not generally pose a suffocation risk; however, they are usually cumbersome and often heavy, making them difficult for children to lift and carry. Additionally, with the exception of some designs that may include a cover or lid, baskets, boxes, bins and drawers are completely open on the top and are therefore not easily portable. Overall, baskets, boxes, bins and drawers do not incorporate any specific design features that make them particularly useable by children.

Tote bags, backpacks and suitcases may not pose a suffocation risk, and certain tote bags, backpacks and suitcases may incorporate some design features that make them particularly useable by children (e.g., scaled-down handles, large zipper pulls, etc.). However, the user is not able to see through the material from which the bag, backpack or suitcase is made in order to distinguish what's inside, and bags, backpacks and suitcases are generally neither designed for, nor useful for, storing children's items.

Plastic storage bags pose a suffocation risk and are not suitable for use by children. Additionally, they do not incorporate any specific design features that make them particularly useable by children.

In addition to the lack of suitable storage solutions for children, there are few securing mechanisms that allow children to zip or unzip storage solutions.

The current offerings for zipper aids may be categorized as "tools to aid in zippering" and "modified zipper pulls" (For illustrative examples, see http://www.arthritissupplies.com/button-aid-and-zipper-pull.html, http://www.arthritissuppiles.com/ring-zipper-pull.html, and http://www.arthritissuppiles.com/zip-grips-zipper-rings.html).

The "tools to aid in zippering" approach is not practical, as the child must have the tool with him or her at all times when assistance with zippering and unzipping is required.

The "modified zipper pulls" approach consists of an "O ring" design, or a slightly modified "O ring" design, that may be attached to an existing zipper pull. The "O ring" design does not aid a user who may not be able to "hook" a finger or a thumb through the "O ring" in order to zip or unzip a zipper.

Accordingly, there is a need in the art for a storage solution that may include a specially-designed zipper pull with design features safely useable by children.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
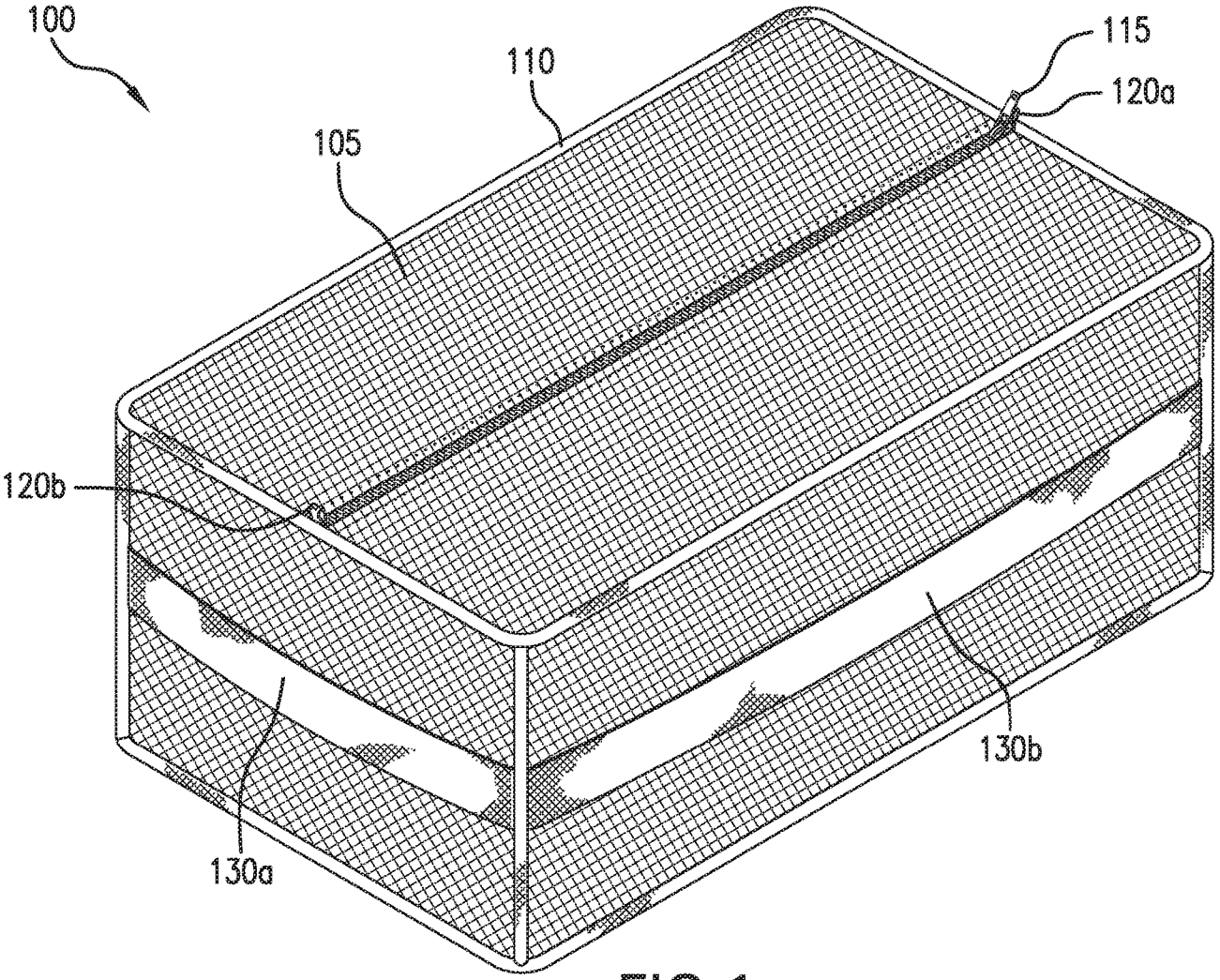
FIG. 1 is a perspective view of an improved storage and transportation device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The storage and transportation device and zipper pull described herein may be used separately or together.

I. Storage and Transportation Device

The storage and transportation device (which may be called KINDER CADDY) may be designed to enable children, including children under three years old, to store and transport items having multiple parts or pieces, such as building blocks, that should be kept together.

Turning to FIG. 1, shown is a storage and transportation device 100. The sides and the top of the storage and transportation device may be constructed of a stiff mesh fabric 105 having a tight weave that is breathable and somewhat "see-through" (i.e., it is not transparent, but the contents of the storage and transportation device are largely identifiable through the mesh fabric). The edges 110 of the storage and transportation device may be made of a rigid fabric-covered cording that allows the storage and transportation device to maintain its box shape, even when nothing is inside. There may be a zipper 115 across the entire length of the center of the top of the storage and transportation device and there may be tabs 120*a*, 120*b* sewn at both ends of the zipper mechanism. The storage and transportation device may have two handles: one short handle 130*a* sewn along the short side of the storage and transportation device, and one long handle 130*b* sewn along the long side of the storage and transportation device.

The product includes various design features to make it easy for young children, having small hands and not fully developed dexterity, to use and to carry. To make the product suitable for use by children, and by children under three years old in particular, the product may be constructed of materials that do not pose a suffocation risk and is designed to be in compliance with the "Small Parts Regulations" (16 C.F.R. Part 1501 and 1500.50-53). The product may also be constructed to be durable and designed to be wipe-able.

The standard storage and transportation device may be approximately the size and shape of a shoe box (about 12"×7"×4½"). It may also be offered in additional sizes (e.g., half the size of a shoe box, double the size of a shoe box, a larger version that would be sized to fit underneath a standard crib/toddler bed, etc.).

The storage and transportation device is specifically designed for use by children, including children under three years old, to both store and transport items having multiple parts or pieces, such as building blocks, that should be kept together.

The following features differentiate the storage and transportation device from the current offerings available for the storage and/or transportation of children's items:

1. The storage and transportation device is constructed of a mesh fabric or other breathable fabrics to eliminate the potential for suffocation.

2. The storage and transportation device is designed so that its contents may be seen and identified through the fabric so that the user does not have to open the storage and transportation device in order to see what is inside.

3. The storage and transportation device is deigned to be box-shaped so that it may be stored and stacked on a flat surface, such as a shelf or a table, or in furniture having flat surfaces, such as a bookcase or a drawer.

4. The storage and transportation device is designed to stand-up on its own, maintaining its box shape even when it is not full or when there is nothing inside.

5. The storage and transportation device incorporates two pull-able handles that are strategically positioned to enable children of differing heights to easily carry it without dragging the storage and transportation device on the ground: for taller children, one handle is sewn along the short side of the storage and transportation device, and for shorter children, a second handle is sewn along the long side of the storage and transportation device.

6. The handles also allow children to easily pull the storage and transportation device out from its stored position on a shelf, in a drawer, etc.

7. The handles on the storage and transportation device are designed to be flush with the sides of the storage and transportation device to allow multiple storage and transportation devices to be seamlessly stored side-by-side.

8. The cording on the edges of the storage and transportation device does not incorporate any wire to eliminate the possibility of puncture injuries.

9. The zipper and zipper pull are nonmetallic so as not to cause burns to the skin should the storage and transportation device be left in a hot place such as outside in the sun or in a car.

10. The zipper features a pull that is of a size that is in compliance with the "Small Parts Regulation" (16 C.F.R. Part 1501 and 1500.50-53). As will be discussed below, a zipper pull may be specially designed to allow for easy grasping and pulling by small hands having limited dexterity.

11. There may be two tabs, one sewn at each end of the zipper, to allow for easy zipping and unzipping by small hands having limited dexterity.

12. The storage and transportation device is constructed to be light weight.

13. The storage and transportation device is constructed with materials that are durable.

14. The storage and transportation device is constructed with all non-toxic materials that are safe for children (e.g., no bisphenol A (BPA), polyvinyl chloride (PVC) or phthalates).

15. The storage and transportation device is wipe-able it may be cleaned using a wet cloth or sponge with or without soap.

16. The storage and transportation device is designed to be reusable, as well as repurposed.

II. Zipper Pull

The zipper pull (which may be called KINDER ZIP) is specifically designed to enable people who have limited dexterity in or use of their hands (e.g., due to injury or a condition such as arthritis), as well as children having small hands and not fully developed dexterity, to zip and unzip a zipper.

Figure 2:
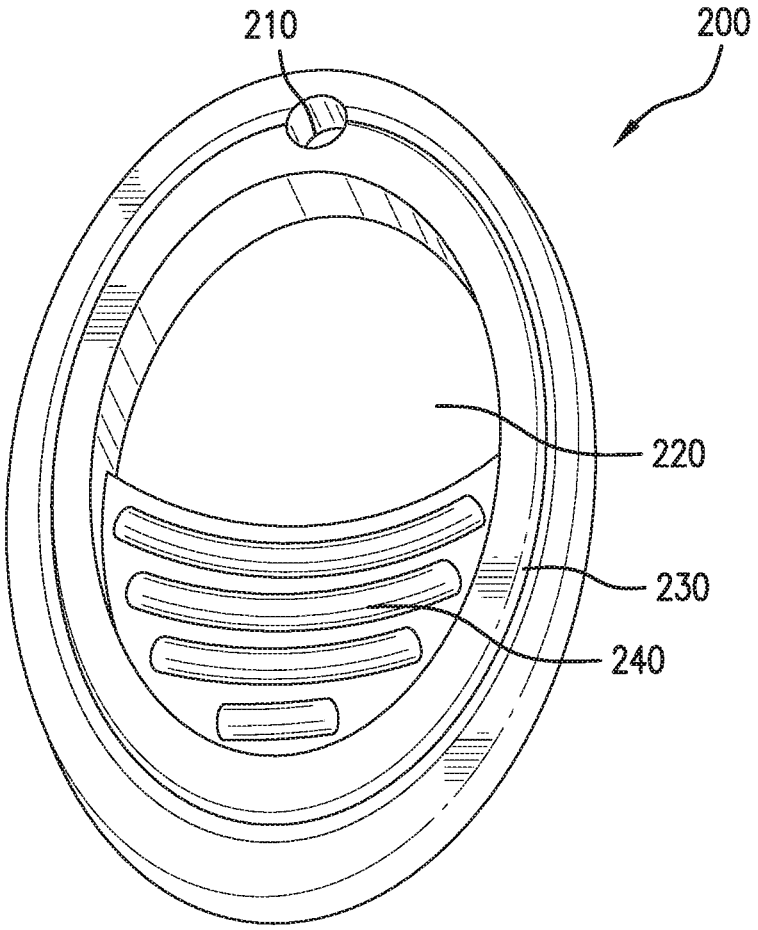
FIG. 2 is a perspective view of an improved zipper pull.

Turning to FIG. 2, shown is a zipper pull 200. The zipper pull is an elliptical shape and may have a minor diameter measuring approximately 1¼" and a major diameter measuring approximately 2". The zipper pull is "hollowed", thus having an open center 220. The bottom end of the hollowed center of the zipper pull incorporates a horseshoe-shaped grip 240 that is textured with finger tread. The zipper pull may include a grooved indentation 230 around its circumference. A small hole 210 is drilled at the top of the zipper pull to allow for the attachment of a fastener (such as a zipper). Further, the features on the front of the zipper pull are mirrored on the back of the zipper pull.

The zipper pull is specifically designed to aid people who have limited dexterity in or use of their hands, including children under three years old, in zipping and unzipping a zipper. The following features differentiate the zipper pull from the current zippering aid offerings available:

1. The overall shape of the zipper pull is specifically designed to enable users to easily find, without looking, the appropriate finger positions for pulling the zipper pull to zip or unzip a zipper.

2. The elliptical shape of the zipper pull incorporates a circumferential grooved body that provides additional textural cues to fingers.

3. The zipper pull features a grip that incorporates finger tread to enable the user to easily grasp the zipper pull with a finger and thumb, and to enable the user to maintain the grasp, while zipping or unzipping a zipper.

4. The zipper pull features an opening that enables the user to "hook" a finger or thumb around the zipper pull to zip or unzip a zipper, thus allowing a user who may not be able to use the grasp feature due to a hand injury or condition or due to wearing gloves or mittens, to be able to zip or unzip a zipper.

5. The zipper pull is of a size that is in compliance with the "Small Parts Regulation" (16 C.F.R. Part 1501 and 1500.50-53).

6. The zipper pull is nonmetallic so as not to cause burns to the skin should the item incorporating the zipper pull be left in a hot place such as outside in the sun or in a car.

7. The zipper pull is constructed from all nontoxic materials that are safe for children (e.g., no bisphenol A (BPA), polyvinyl chloride (PVC) or phthalates).

8. The zipper pull allows for the attachment of a fastener that permits it to be affixed to existing zipper pulls.

9. The zipper pull is designed to be removable and reusable.

10. The zipper pull is constructed to be light weight with materials that are durable and washable.

11. The zipper pull is constructed with materials that are washable.

In the foregoing specification, specific embodiments have been described. However, one of ordinary skill in the art appreciates that various modifications and changes can be made without departing from the scope of the invention as set forth herein. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A mechanism comprising:

a flat elliptical body having a front side and a rear side and having a circumference section and a center section;

wherein the circumference section comprises a circumferential groove on the front side, a circumferential groove on the rear side, and a first hole through a portion of the circumference section;

wherein the center section comprises a gripping mechanism and a second hole through a substantial portion of the center section that is adjacent to the gripping mechanism;

wherein the gripping mechanism comprises at least two front ridges that protrude from the front side at approximately the same height, and a non-protruding front gap between each adjacent pair of the at least two front ridges;

wherein the gripping mechanism further comprises at least two rear ridges that protrude from the rear side at approximately the same height, and a non-protruding rear gap between each adjacent pair of the at least two rear ridges;

wherein each of the at least two front ridges is curved and wherein each of the at least two rear ridges is curved;

wherein the center of each of the at least two front ridges bulges away from the second hole and wherein the center of each of the at least two rear ridges bulges away from the second hole;

wherein the gripping mechanism and the second hole are of a size capable of being used by children; and wherein the flat elliptical body comprises materials that are safe for use by children.

2. The mechanism as in claim 1, further comprising an external zipper slider mechanically engaged with the first hole.

3. The mechanism as in claim 1, wherein the flat elliptical body is in compliance with small parts regulations in Title 16 of the Code of Federal Regulations, Part 1501 in effect on May 5, 2015.

4. The mechanism as in claim 1, wherein the area of the gripping mechanism is greater than one-third of the area of the center section.

5. The mechanism as in claim 1, wherein the at least two front ridges comprise a first front ridge, a second front ridge, a third front ridge, and a fourth front ridge;

wherein the first front ridge is between the second hole and the second front ridge, and is larger than the second front ridge;

wherein the second front ridge is between the first front ridge and the third front ridge, and is larger than the third front ridge;

wherein the third front ridge is between the second front ridge and the fourth front ridge, and is larger than the fourth front ridge; and wherein the fourth front ridge is between the third front ridge and the circumference section.

6. The mechanism as in claim 5, wherein the plurality of the curved ridges on the rear side comprise a first rear ridge, a second rear ridge, a third rear ridge, and a fourth rear ridge;

wherein the first rear ridge is between the second hole and the second rear ridge, and is larger than the second rear ridge;

wherein the second rear ridge is between the first rear ridge and the third rear ridge, and is larger than the third rear ridge;

wherein the third rear ridge is between the second rear ridge and the fourth rear ridge, and is larger than the fourth rear ridge; and wherein the fourth rear ridge is between the third rear ridge and the circumference section.

* * * * *